United States Patent [19]

Shuman

[11] Patent Number: 4,677,780

[45] Date of Patent: Jul. 7, 1987

[54] MAGNETICALLY SECURED DISPLAY APPARATUS

[75] Inventor: Bernard E. Shuman, Merrick, N.Y.

[73] Assignee: EEE Corporation, Port Washington, N.Y.

[21] Appl. No.: 798,954

[22] Filed: Nov. 18, 1985

[51] Int. Cl.[4] ..... G09F 3/04

[52] U.S. Cl. ..... 40/600; 40/10 R; 211/DIG. 1

[58] Field of Search ..... 40/600, 10 R, 606; 248/205.6, 205.1, 214, 219.2; 211/DIG. 1

[56] References Cited

U.S. PATENT DOCUMENTS

| | | | |
|---|---|---|---|
| 431,562 | 7/1890 | Dean et al. | 40/10 R |
| 1,317,589 | 9/1919 | Noziska | 40/10 R |
| 1,396,910 | 11/1921 | Annable | 40/10 R |
| 1,715,237 | 5/1929 | Huston | 40/10 R |
| 1,837,585 | 12/1931 | Redinbaugh | 248/214 |
| 2,689,050 | 9/1954 | Albin | 40/606 |
| 2,825,160 | 3/1958 | Mellor et al. | 40/10 R |
| 3,296,725 | 1/1967 | Fenwick | 40/10 R |
| 3,497,977 | 3/1970 | Bradford | 40/10 R |
| 4,028,827 | 6/1977 | Hufton | 40/600 |

*Primary Examiner*—Gene Mancene
*Assistant Examiner*—Cary E. Stone
*Attorney, Agent, or Firm*—Henry Sternberg; Bert J. Lewen

[57] ABSTRACT

A sign holder for displaying identifying characteristics of merchandise on a display rack. The sign holder has a plate-like upper portion for holding the sign and an L-shaped clamp for securing the upper portion to a rod of the display rack. One leg of the L-shaped clamp is supported on the top surface of the rod while the other leg extends downwardly in face-to-face contact with a vertical side of the rod. A magnet member in the downwardly extending leg adheres the clamp to the rod to prevent inadvertant dislocation of the sign holder.

11 Claims, 16 Drawing Figures

Fig. 1.
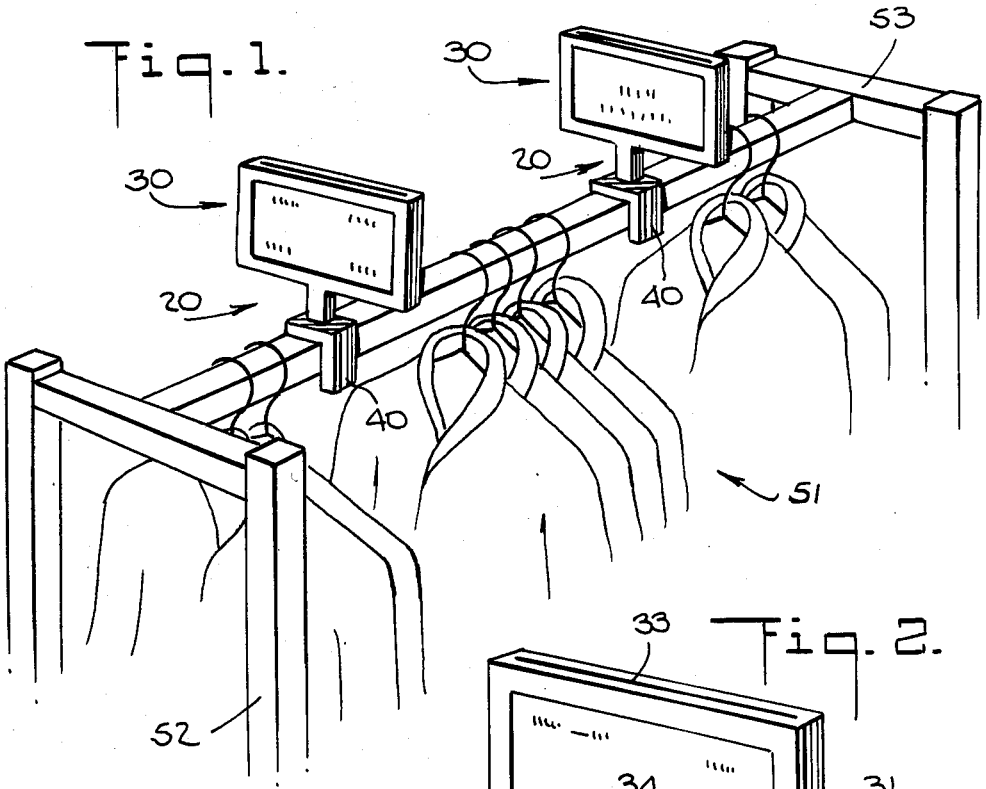
Fig. 2.
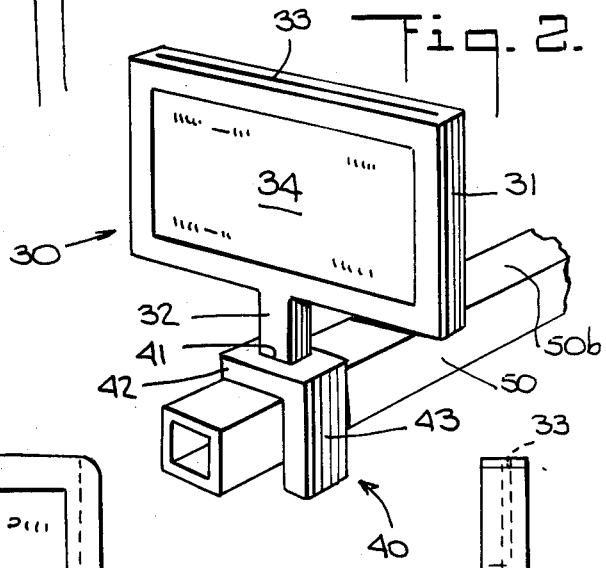
Fig. 3.
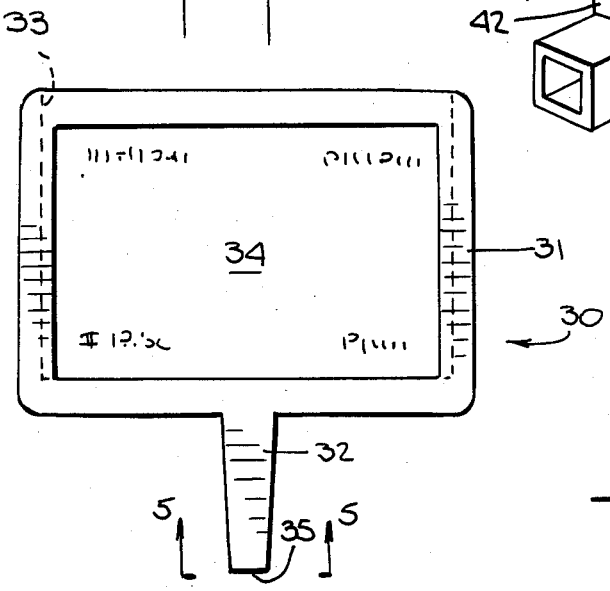
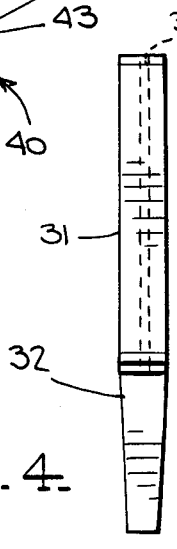
Fig. 4.

Fig. 8.
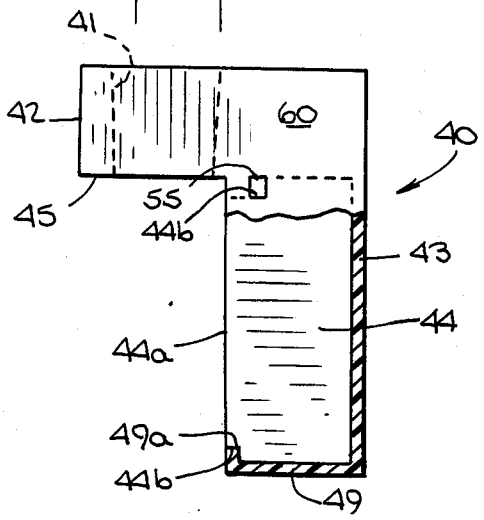
Fig. 9.
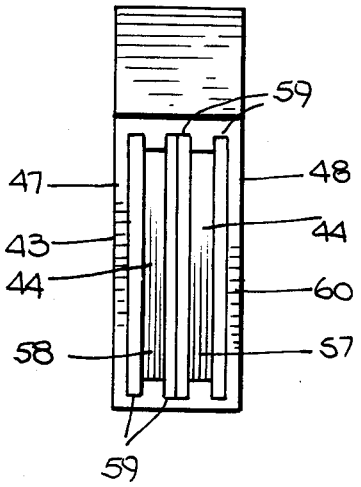
Fig. 6.
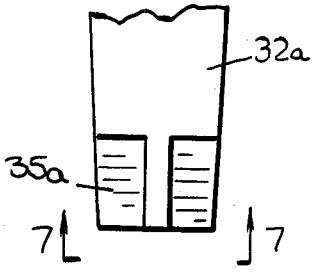
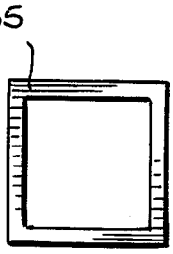
Fig. 5.
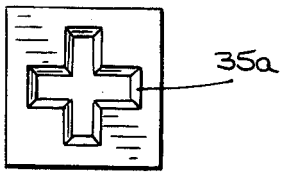
Fig. 7.
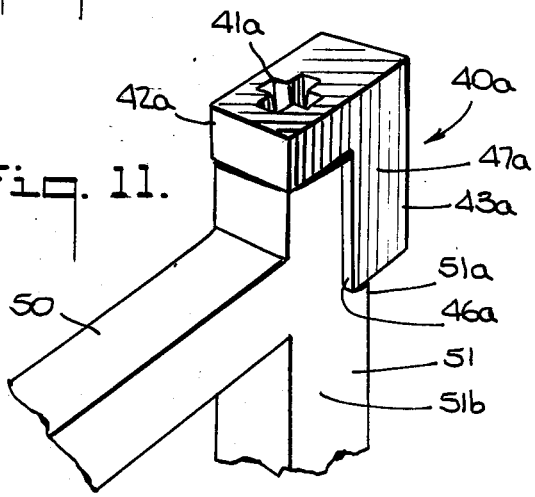
Fig. 11.
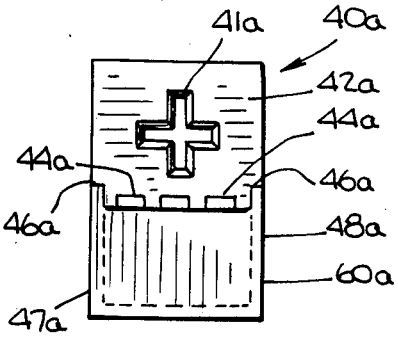
Fig. 10.

Fig. 13.
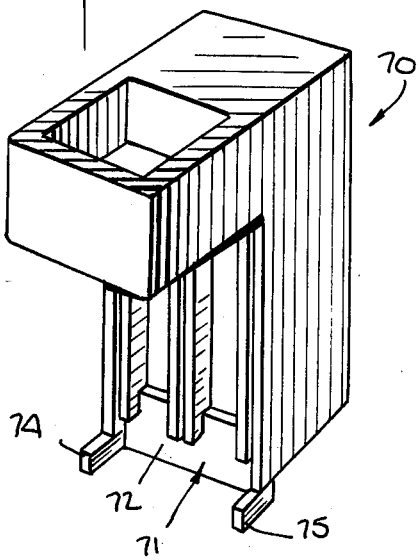
Fig. 12.
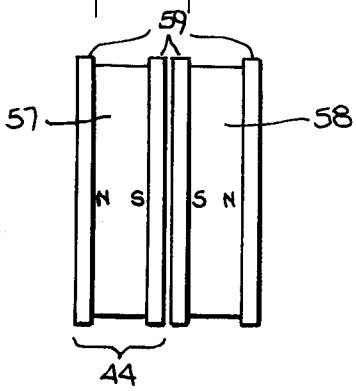
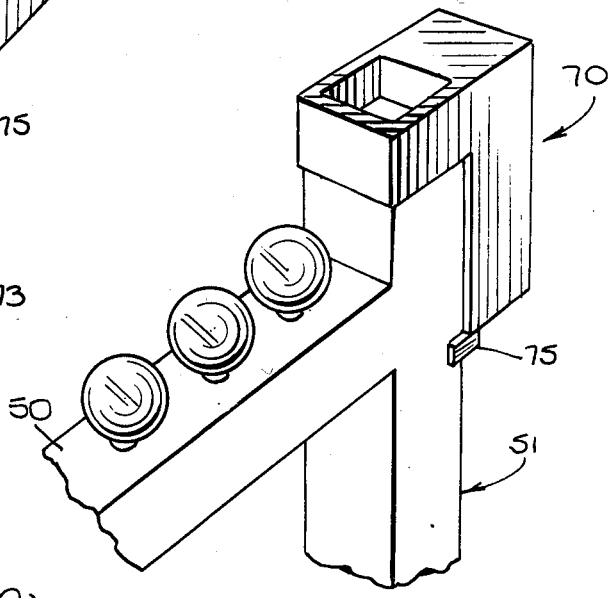
Fig. 14.
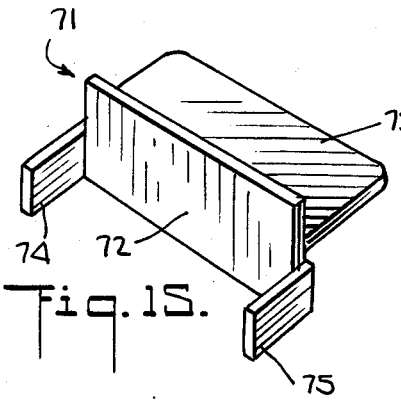
Fig. 15.
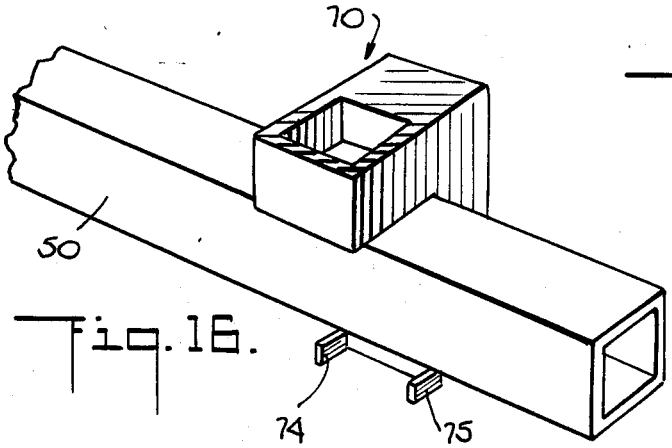
Fig. 16.

MAGNETICALLY SECURED DISPLAY APPARATUS

FIELD OF THE INVENTION

This invention relates to point of sale display equipment and is more particularly concerned with a sign holder which can be readily shifted to any desired position on a rack or similar support for articles on display such as, for example, clothing. The invention relates particularly to such a sign holder which, while readily shiftable to any desired position on the rack, resists inadvertent displacement out of any such position in which it is placed.

BACKGROUND OF THE INVENTION

When merchandise is displayed on racks for retail sale, or the like, it is desirable for various kinds, brands and sizes of merchandise on a particular rack to be separated by signs which are indicative of the type, size, etc., of the merchandise in the next adjacent group of merchandise on the rack. These signs are typically in the form of frames, panels, or other card-holders, which hold display cards above the rack indicating to the customer information, for example, as to the size and/or type of merchandise on the other side of the sign. Thus, these signs encourage neat stocking of the display racks and orderly, attractive, displays of the merchandise that facilitates selection by the customer and promotes sales.

To be satisfactory, such a sign should be sufficiently large so that the message thereon can be easily read or seen by customers, even those whose eyesight is not the best, yet without interfering with the overall appearance of the retail establishment or with the ability of customers to observe other merchandise displays in the store, while standing close to one of such displays. The card holders must also not interfere with removal of merchandise from the racks, whether by the customers or by employees. Display cards, or signs, of approximately seven to eight inches in height and ten to eleven inches in width, have been found satisfactory. Such cards require panels or card holders of substantially the same size, or, if the card holder is in the form of a frame supporting the sign therein, only slightly larger in size. Obviously such card holders should also be inexpensive and are, therefore, typically formed of plastic material. While the card holder should be relatively light in weight, the sheer size of the cards and the necessary frame results in a considerable overlying weight for the assembly, which is typically mounted on a central downwardly extending stem; the two opposite end portions of the frame being essentially cantilevered with respect to the stem.

Nevertheless, once in place on a rack the sign holder should securely resist inadvertent displacement. Merchandise display arrangements are changed rather frequently, however, to stimulate customer interest and keep up with product changes and changing demands; and, therefore, deliberate shifting of a card holder should be quickly and easily accomplished. Since clothing racks typically have horizontal supports in the form of rods having a rectangular cross-section and since the panel of the sign holders extends a substantial distance on each side of such rod and must be balanced thereon through the central stem of the card holder, the known devices had their stems attached to a base supported on, and magnetically adhered to, the top horizontal surface of such rod. The magnets used had to be rather strong since otherwise the card holders of the prior art could readily be inadvertently moved from their desired position on the rack. Such strong magnets, however, added substantially both to the weight and to the cost of the prior art card holders. The rods of clothing racks typically have a vertical height dimension substantially greater than the horizontal width dimension. Consequently, only a relatively narrow horizontal surface is available at the top of such rod for magnetic attachment, which is one principal reasons why the prior art sign holders, supported entirely on such top surface, required a relatively powerful magnet.

SUMMARY OF THE INVENTION

Having in mind the deficiencies of known sign holders and the several apparently incompatible requirements that must be met in a satisfactory sign holder, the general object of this invention is to provide a low cost but attractive sign holder that does not require a particularly strong magnet, is capable of being installed with practically no efffort, is capable of being instantly shifted from place to place on a rack but is, nevertheless, able to resist inadvertent displacement out of any position in which it may be placed although not dependent upon a screw-type or similar clamp for its securement.

Another and more specific object of the invention is to provide a sign holder of the above described character that is capable of satisfactory operation with a much less powerful and thus smaller, lighter and cheaper magnet than was previously required.

It is also a specific object of this invention to provide a sign holder of the character described that has the ability to take advantage of the larger side-face of the rod member without requiring a still more powerful magnet, such as would be required if the entire weight of the sign holder would have to be supported by the magnetic attraction of a magnet acting only against the side face of the rod.

In general, these and other objects of the invention that will appear as the description proceeds, are achieved with the sign holder of this invention, for use on a rack support rod of magnetically permeable material. The sign holder is characterized by an upright panel, or card holder, having a central support stem extending downwardly therefrom, and an inverted L-shaped support member, or clamp, adapted to be supported on the rod of the rack, with the horizontal top leg of the L-shaped support member spuported on the top horizontal surface of such rod and the vertical portion of the L-shaped member adjacent the vertical side surface of the rod. The vertical portion of the L-shaped member includes a permanent magnet adapted to engage the side surface of the rod, while the horizontal portion of the L-shaped member includes a connecting means for detachably connecting thereto the lower portion of the stem of the card holder component of the sign holder.

The invention comprises a sign holder for holding a vertical planar sign on a magnetically attractable support rod of a clothing rack, or the like, comprising a frame member for securing the sign, and clamp means for connecting the frame member to the rod. The clamp means include (i) an L-shaped housing having a first leg portion and a transverse second leg portion extending from one end of the first leg portion, (ii) permanent magnet means integrally connected to the first leg portion for detachably magnetically clamping such first leg portion to a vertical surface portion of the rod, while the second leg portion overlies and is supported on a horizontal surface portion of the rod, and (iii) connecting means for detachably connecting the frame member to the transverse second leg portion for supporting the frame member and the sign secured thereto in a substantially vertical plane when the first leg portion is magnetically attached to the vertical surface portion of the rod. Consequently, the weights of the frame member and the sign secured thereby pass thru the second leg portion to, and are borne entirely by, the rod. The magnet means thus serves only to resist displacement of the sign holder and is not required to support any of the weight of the sign holder. Furthermore, the direction of magnetic attraction is such as to impede the most common causes of inadvertent displacement of the sign holder.

BRIEF DESCRIPTION OF DRAWINGS

In the accompanying drawings, which illustrate what are now regarded as preferred embodiments of the invention:

FIG. 1 is a perspective view of a pair of sign holders embodying the principles of this invention, installed on a clothing rack to define portions thereof allocated to particular items of merchandise;

FIG. 2 is a enlarged perspective view showing one of the sign holders according to the present invention seen in FIG. 1 installed on a rod, of which only a fragmentary portion is shown;

FIG. 3 is a front elevational view of the card holder component portion of the sign holder of FIGS. 1 and 2 in accordance with the invention;

FIG. 4 is a side elevational view of the card holder component portion in FIG. 3;

FIG. 5 is a view taken in the direction of the arrows 5—5 in FIG. 3;

FIG. 6 is a fragmentary front elevational view showing the bottom end of a stem according to another embodiment of the present invention;

FIG. 7 is a view taken in the direction of the arrows 7—7 in FIG. 6;

FIG. 8 is a front elevational view of the magnetic clamp component of the sign holder according to the present invention;

FIG. 9 is a side elevational view of the magnetic clamp component according to FIG. 8;

FIG. 10 is a bottom view of still another embodiment of a magnetic clamp component according to the present invention, having a pair of opposed side flanges for alignment with opposite side surfaces of a vertical rod of a clothing rack, or the like;

FIG. 11 is a perspective view of the magnetic clamp component according to FIG. 10, showing the latter in position mounted on the top end of a vertical rod of a clothing rack, of which only a fragmentary portion is shown;

FIG. 12 is a schematic view of the magnets according to the present invention;

FIG. 13 is a perspective view of still a further embodiment of the invention;

FIG. 14 is a perspective view of the FIG. 13 embodiment shown in position on a vertical rod;

FIG. 15 is a perspective view of the end closure and tab means of the FIG. 13 embodiment; and FIG. 16 is a perspective view of the FIG. 13 embodiment shown on a horizontal rod.

DETAILED DESCRIPTION OF PREFERRED EMBODIMENTS OF THE INVENTION

A sign holder 20 that embodies the principles of this invention, is seen in FIGS. 1 and 2 and comprises, in general, a card holder assembly 30, and a magnetic clamp 40.

The card holder 30 is preferably molded of plastic and preferably comprises a frame 31 and a downwardly depending, preferably centrally located, stem 32, rigidly connected to the frame. The frame is preferably provided with a central slit 33 opening on top for inserting a vertical card such as card 34 which may have printing or other indicia thereon. See FIGS. 3 and 4.

Stem 32 has a bottom end portion 35, as seen in FIG. 4 and 5, adapted to be inserted and detachably held in a similarly shaped opening 41 of the clamp 40. Clamp 40, also preferably molded of plastic, is shaped in the form of an inverted "L" having, as shown in FIG. 8, a horizontal top portion 42 and a vertical side portion 43. The clamp 40 is preferably of hollow shell construction and has permanent magnets 44 retained in the elongated vertical side portion 43 thereof. The permanent magnets 44 are preferably of generally rectangular construction, having front edge faces **44*a* (FIG. 8), adapted to magnetically adhere to the side surface 50*a* of a rod 50 which forms the support rod for a conventional clothing rack 51, or the like, as seen in FIGS. 1 and 2**.

Rod 50, to which the sign holder according to the instruction, is adapted to be connected, typically has a generally rectangular cross-section and has a horizontal top surface **50*b* at right angles with the vertical side surface 50*a*. Rod 50 is of magnetically permeable material such as, for example, iron and, as seen in FIG. 1, typically extends in generally horizontal direction between a pair of spaced vertical support frames 52 and 53**.

According to a preferred embodiment of the invention the bottom end portion 35 of the stem 32 is of generally square cross-section and the horizontal leg 42 of the clamp 40 has a vertical bore 41 of a corresponding square cross-section extending therethrough. The bottom end 35 of the stem is preferably slightly tapered, with the smaller end of the taper being at the bottom end of the stem and having dimensions slightly smaller than the bore 41, while the upper portion of the stem has dimensions slightly larger than the bore 41 so that the stem 32 may be easily inserted into the bore until the walls of the bore engage the tapered stem and hold it in position.

It will be seen that in accordance with the invention, the vertical sides of the card holder 30 extend a substantial horizontal distance on opposite sides of the rod 50, when in use, and represent a fairly substantial cantilevered weight on each side of the rod.

As noted above, the clamp 40 includes a generally L-shaped, hollow, preferably plastic, housing 60. The housing 60 includes a horizontally disposed leg 42 which, in use, overlies the upper surface **50*b* of the rod 50 so as to provide a principal supporting means for the card holder 30. The stem 32 of the card holder 30 is, in use, disposed substantially centrally with respect to the top surface 50*b* of rod 50 so that the entire weight of the card holder 30 will be downwardly imposed, through the upper leg 42 of clamp 40 and directly onto the support surface 50*b*** of the rod.

The magnetic force of attraction, on the other hand, is exerted against the vertical surface **50*a* of the rod 50** and since this magnetic force does not have to bear any of the weight of the card holder 30 it can be of substantially reduced strength and light weight. Thus, the magnets 44, which magnetically clamp onto the vertical surface 50*a* along their own vertical front surfaces 44*a*, merely provide a securing force for securing the clamp 40 to the rod 50 at a desired location therealong and for resisting accidental displacement out of such location. The lower edges of the walls forming the hollow leg portion 42 of the housing, lie in a generally horizontal plane 45 (when in use) and are adapted to be supported on the top surface 50*b* of rod 50. It is the rectangular relationship between the plane of the lower surface 45 of the horizontal leg and the front vertical faces 44a of the magnets, which provides the stability uniquely provided by the support structure according to the present invention, without requiring heavy, high-strength, magnets. The magnets according to the present invention, which have been found suitable for use in the structure according to the invention are a pair of plate-shaped barium ferrite ceramic magnets 57 and 58. Each of the pair of magnets includes a pair of steel poles 59. The poles 59 are also flat, plate-shaped members positioned at opposite faces, respectively, of the ferrite portion of each magnet. The pair of magnets 57, 58 are preferably oriented in magnetic opposition to one another, as seen in FIG. 12, to enhance the magnetic strength.

According to another embodiment of the invention the stem 32*a* is provided with a bottom portion 35*a* having an X-shaped configuration, as seen in FIGS. 6 and 7, instead of the tapered rectangular configuration of the embodiment of FIG. 5. The X-shaped configuration is also preferably slightly tapered and adapted to fit into a clamp 40*a* shown in FIGS. 10 and 11, where the horizontal leg 42*a* has an X-shaped a vertical bore 41*a* for detachably receiving therein the lower portion 35*a* of stem 32*a*.

According to the embodiment of the invention seen in FIGS. 10 and 11, the clamp 40*a* has a vertical leg 43*a* with a configuration identical to the vertical leg 43 of clamp 40, with the exception that the elongated front faces 44*a*' of the poles 59 of the permanent magnets 44*a*, are seated behind the front edges 46*a* of the opposite wall portions 47*a* of the hollow clamp housing 60*a*. Thus, the configuration is such that the plane locating the front faces 44*a*' of the poles of permanent magnets 44*a*, is located behind the plane locating the edges 46*a* of the side walls 47*a* of the clamp housing. The space between the inwardly facing surfaces of the walls 47*a* is chosen such that these wall surfaces fit snugly against opposite side surfaces of a vertical rod 51, as seen in FIG. 11. Thus, when positioned in this manner, the front faces 44*a*' of the permanent magnets 44*a* will be in face-to-face contact with the front vertical surface 51*a* of a vertical rod 51 and the side walls 47*a* will, at the same time, embrace the opposite sides 51*b* of that vertical rod 51. This latter embodiment, therefore, provides an additional support, namely, the side walls 46*a*, for preventing accidental horizontal or rotational dislocation of the clamp from the top of such vertical rod.

A still further embodiment of the invention, illustrated in FIGS. 13–16, inclusive, has a clamp substantially identical to the clamp 40 of FIG. 4 except that it has an end closure 71 which has a horizontal wall portion 73 for forming the bottom end wall of the vertical clamp portion, a vertical wall 72 forming the bottom retaining means for the magnets by extending into a corresponding groove in the magnets, and a pair of horizontally extending tabs 74 and 75. The tabs 74 and 75 are spaced apart a distance substantially equal to the width of vertical rod 51 (see FIG. 14) for providing a stop means to inhibit accidental displacement of the clamp particularly when it is mounted on a vertical rod 51, but also, in the case of certain horizontal rods, whose dimensions permit. The closure 71 may be glued or otherwise assembled with the housing of clamp 70 by conventional connecting means.

Preferably, each of the magnets 44 consists of an assembly of elongated rectangular plate-shaped members including a permanent magnet 57, 58 each sandwiched between a pair of pole plates 59 with preferably one such magnet assembly 44 adjacent each of the side walls 47 and 48. The magnet assemblies are oppositely oriented so that the "south" poles of each of the magnet assemblies 44 are adjacent each other and centrally located between the outer pair of "north" poles. Also, the poles of the magnets are preferably shaped with a pair of stepped portions, or shoulders, 44*b*, seen in FIG. 8, at the opposite end faces thereof, for retaining the magnets in place. This is accomplished by providing a securing member such as, for example, a horizontal pin 55 fixed at opposite ends to the side walls 47 and 48, respectively, and engaging one of the stepped portions or shoulders 44*b* of all of the poles of the magnets while a spaced end wall 49 of the housing is provided with a shoulder 49*a* which engages the opposite stepped portions 44*b* of the poles for cooperating with pin 55 to retain the magnets in position within the housing.

In use, these magnetic clamps are extremely convenient since they can be readily positioned anywhere along a rod, such as rod 50, and at some later time can be readily removed or displaced to a different location along the rod. No unscrewing of any screw-type clamp mechanism, as is presently conventionally required, is necessary. There are no moving parts and no screws to be lost. The clamps are very neat in appearance and do not have any screw handle parts which can get caught on clothing or otherwise cause damage. The design of the clamp is such that the weight of the cardholder will be transmitted through the top horizontal leg of the clamp directly onto the support rod and the magnetic force of the magnets in the vertical portion of the clamp need be only strong enough for preventing accidental dislocation of the sign holder.

The most common inadvertent displacement of a sign holder of this general type results from an accidental brushing against the card holder frame by a customer or employee removing an article of clothing from the rack. With conventional magnetic sign holders the support was merely a flat magnet base which rested on the top horizontal surface of the rod. Since such rods are typically of rectangular cross-section, the surface on which the magnet rests is relatively narrow and required a magnet of substantial strength to resist inadvertent contact. Typically, the inadvertent forces will be applied at one end of the card holder and tend to rotate the sign holder, with respect to the rod, such that the flat magnet support surface rotates in its own plane with respect to the top surface of the rod, to a position in which less and less of the magnet surface overlies the narrow top face of the rod and eventually falls off or is moved out of position. The prior art sought to avoid this by making the magnet substantially stronger, and consequently heavier and more costly.

With the structure of the present invention, on the other hand, there are not only provided two surfaces at right angle to one another, which cooperate to resist accidental movement, but the magnetic forces are located such that they provide maximum resistance to the typical inadvertent forces on such sign holders. Thus, any tilting movement on the sign holder is resisted not only by the full magnetic force available, but also mechanically, as a result of the horizontal leg of the clamp being in surface-to-surface contact with the top surface of the rod and at right angle to the magnetic force exerted by the vertical leg.

From the foregoing description taken with the accompanying drawings it will be apparent that this invention provides a very simple, inexpensive, but attractive, support means for signs capable of being installed in an instant on a metal rod and capable of being instantly shifted from place to place on the rod but, nevertheless, capable of resisting inadvertent displacement out of any position in which it may be placed.

What is claimed is:

1. A sign holder for securing a vertical planar sign on a magnetically attractable support rod of a clothing rack, or the like, comprising:

a frame member for holding the sign; and clamp means for connecting said frame member to said rod, said clamp means including, (i) an L-shaped tubular housing having a first leg portion and a transverse second leg portion extending from one end of said first leg portion, (ii) permanent magnet means integrally connected to said first leg portion for detachably magnetically clamping said first leg portion to a vertical surface of the rod, with said second leg portion overlying and supported on an upper horizontal surface of the rod, and (iii) connecting means for detachably connecting said frame member to said transverse second leg portion for supporting said frame member and the sign held therein in a substantially vertical plane when said first leg portion is magnetically attached to said vertical surface of said rod, whereby the weight of the frame member and the sign held therein passes through said second leg portion to, and is borne entirely by, the rod, said magnet means serving only to resist displacement of the sign holder.

2. A sign holder according to claim 1, wherein said first leg portion defines a first inner face adapted to be in face-to-face contact with said vertical surface of the rod and said second leg portion defines a second inner face adapted to be in face-to-face contact with the upper horizontal surface of said rod when said clamp means is magnetically adhered to said rod.

3. A sign holder according to claim 1 wherein said connecting means comprises a vertical stem extending downwardly from the frame member and a cavity in said second leg portion adapted to detachably receive said stem.

4. A sign holder according to claim 3, said cavity being X-shaped and said stem having a corresponding X-shaped end portion adapted to be received in said cavity.

5. A sign holder according to claim 4, wherein said connecting means include releasable locking means for releasably retaining said stem in said cavity.

6. A sign holder according to claim 3, said stem having a tapered end portion adapted to be secured in said cavity.

7. A sign holder according to claim 1, wherein the rod is a horizontal rod having a rectangular transverse cross-section and said housing defines a hollow first leg portion having a pair of opposite walls with front edges, said permanent magnet means includes at least one permanent magnet in said hollow first leg portion and having a front face located in a vertical plane at least as far forwardly as the vertical edges of said housing, whereby said front face of said magnet is in face-to-face contact with the vertical surface of the rod when said clamp means are attached.

8. A sign holder according to claim 1, wherein the rod is a vertical rod having a rectangular transverse cross-section having opposite side faces thereof spaced by a given width dimension and said housing defines a hollow first leg portion having a pair of opposite side walls spaced a distance closely approximating but only slightly larger than said given width dimension adapted to embrace said opposite side faces of the rod, and having generally vertical front edges, said permanent magnet means includes at least one permanent magnet in said first leg portion and having a front face located rearwardly of the generally vertical front edges of said housing, whereby said front face of said magnet is in face-to-face contact with the vertical surface of the rear face of the rod intermediate said side faces thereof when the side walls of said housing embrace said opposite side faces, respectively, of said rod.

9. A sign holder according to claim 1, wherein said permanent magnet means is not of sufficient magnet strength, acting on a vertical surface of said rod, to prevent downward slippage of said frame due to its weight, such downward movement being prevented by the support of the horizontal surface of the rod under said second leg portion.

10. A display device of the type having a generally planar vertical display portion for displaying information on merchandise racks having structural rod members with vertical and horizontal surfaces of magnetically permeable material and a clamp portion for releasably connecting said display portion to such structural rod member, characterized by, (a) said clamp portion being generally L-shaped and having a tubular horizontal leg adapted to overlie and be supported on the horizontal surface of the rod member and a tubular vertical leg adapted to overlie and contact the vertical surface of the rod member, and (b) permanent magnet means in said vertical leg of said clamp portion for magnetically attracting the vertical surface of the rod member for adhering said clamp portion thereto, (c) said display portion including a connecting portion and said horizontal leg of said clamp portion comprising connecting means adapted to releasably receive said connecting portion of said display portion whereby the entire weight of said display portion is supported solely by the rod member and said magnet means need have sufficient magnetic strength to only minimize the risk of inadvertent displacement of said display portion, without having to support the weight thereof.

11. A display device of the type having a generally planar vertical display portion for displaying information on merchandise racks having structural rod members with vertical surfaces of magnetically permeable material and a clamp portion for releasably connecting said display portion to such structural rod member, at least one of said rod members being a vertical rod having a rectangular transverse cross-section having opposite side faces thereof spaced apart by a given width dimension, and having a generally horizontal top surface, said display device characterized by:

(a) said clamp portion being generally L-shaped and having a horizontal leg adapted to overlie and be supported on the horizontal surface of the said vertical rod and a vertical leg adapted to overlie and contact the vertical surface of said vertical rod member, said vertical leg comprising a hollow housing portion, (b) permanent magnet means in said hollow housing portion of said vertical leg of said clamp portion for magnetically attracting the vertical surface of the said vertical rod member for adhering said clamp portion thereto, (c) said display portion including a connecting portion and said horizontal leg of said clamp portion comprising connecting means adapted to releasably receive said connecting portion of said display portion whereby the entire weight of said display portion is supported solely by said vertical rod member and said magnet means need have sufficient magnetic strength to only minimize the risk of inadvertent displacement of said display portion, without having to support the weight thereof, and (d) said clamp portion further comprising a bottom closure means for closing said hollow housing portion at the bottom end thereof and a pair of tab means integral with said bottom closure means and extending forwardly of said magnet means for embracing said vertical rod at said opposite side faces thereof for preventing inadvertent displacement of said display portion.

* * * * *